US007775513B2

(12) United States Patent
Desfosses et al.

(10) Patent No.: US 7,775,513 B2
(45) Date of Patent: Aug. 17, 2010

(54) MOBILE FEEDER SYSTEM

(75) Inventors: Michael David Desfosses, Deerfield, NH (US); Richard Craig Meyer, Alfred, ME (US)

(73) Assignee: Goss International Americas, Inc., Durham, NH (US)

( * ) Notice: Subject to any disclaimer, the term of this patent is extended or adjusted under 35 U.S.C. 154(b) by 276 days.

(21) Appl. No.: 11/894,497

(22) Filed: Aug. 20, 2007

(65) Prior Publication Data

US 2008/0042338 A1 Feb. 21, 2008

Related U.S. Application Data

(60) Provisional application No. 60/839,108, filed on Aug. 21, 2006.

(51) Int. Cl.
*B65H 5/00* (2006.01)

(52) U.S. Cl. ..... 270/52.2; 270/52.21; 270/52.22; 270/52.16; 270/52.18

(58) Field of Classification Search ..... 270/52.16, 270/52.2, 52.21, 52.22, 52.18, 52.19, 52.26, 270/52.29

See application file for complete search history.

(56) References Cited

U.S. PATENT DOCUMENTS

| | | | | |
|---|---|---|---|---|
| 3,809,385 | A | 5/1974 | Rana | |
| 4,177,979 | A * | 12/1979 | Orsinger et al. | 270/52.16 |
| 4,198,039 | A | 4/1980 | Bryson et al. | |
| 4,660,280 | A * | 4/1987 | Asai et al. | 29/759 |
| 5,067,700 | A | 11/1991 | Dick | |
| 6,082,724 | A | 7/2000 | Kahlig et al. | |
| 6,431,319 | B1 | 8/2002 | Myers et al. | |
| 6,615,973 | B2 | 9/2003 | Fritter | |
| 6,832,758 | B2 * | 12/2004 | Richter et al. | 271/8.1 |
| 7,438,107 | B2 * | 10/2008 | Kost | 156/564 |
| 2003/0047857 | A1 * | 3/2003 | Peier | 270/52.16 |
| 2006/0103064 | A1 | 5/2006 | Sittinger et al. | |
| 2008/0042336 | A1 * | 2/2008 | Desfosses et al. | 270/52.16 |

* cited by examiner

*Primary Examiner*—Patrick Mackey
*Assistant Examiner*—Ernesto Suarez
(74) *Attorney, Agent, or Firm*—Davidson, Davidson & Kappel, LLC

(57) ABSTRACT

A mobile feeder system is provided including a feeder having a center of gravity, and an intermediate feeder base supporting the feeder for horizontal movement between a cantilevered position in which the center of gravity lies outside the intermediate base and a non-cantilevered position in which the center of gravity lies over the intermediate base. A gathering device is also provided.

6 Claims, 8 Drawing Sheets

MOBILE FEEDER SYSTEM

This claims the benefit of U.S. Provisional Application No. 60/839,108, filed on Aug. 21, 2006 and hereby incorporated by reference herein.

BACKGROUND

The present invention relates to printing presses and more particularly to specialty feeders, for example card or cover feeders.

Gathering devices such as perfect binders, saddle stitchers and mailroom inserters may use hoppers or feeders to collect sheet material. A saddle stitcher or perfect binder may for example collect folded printed materials fed from hoppers or feeders onto a saddle or perfect binder conveyor, respectively, to form a magazine or other printed product. In the context of the present application, the term hopper and feeder are used synonymously.

U.S. Pat. No. 4,198,039 purports to disclose an apparatus for delivering sheets particularly cover sheets from a supply thereof to a saddle-type collating apparatus for assembly with other signatures. The cover feeder is constructed to first score the cover then fold it.

U.S. Pat. No. 6,082,724, hereby incorporated by reference herein, describes a signature collating apparatus such as an inserter having a plurality of hoppers delivering sheet material to receiving locations on a conveyor.

U.S. Publication No. 2006/0103064 purportedly discloses modular signature feeders that include a frame having a base configured to enable the modular signature feeder to be removably attached to another modular signature feeder or a signature transfer assembly associated with a signature collation feeder assembly.

SUMMARY OF THE INVENTION

In accordance with an embodiment of the present invention, a mobile feeder system includes a feeder having a center of gravity. An intermediate feeder base is provided supporting the feeder for horizontal movement between a cantilevered position in which the center of gravity lies outside the intermediate base and a non-cantilevered position in which the center of gravity lies over the intermediate base.

In accordance with another embodiment of the present invention, a gathering device includes a gathering conveyor and a plurality of feeders. Each feeder is positioned to feed sheet material to the gathering conveyor. At least one of the plurality of feeders is a mobile feeder. The mobile feeder includes a center of gravity. The mobile feeder also includes an intermediate feeder base supporting the feeder for horizontal movement between a cantilevered position in which the center of gravity lies outside the intermediate base and a non-cantilevered position in which the center of gravity lies over the intermediate base, and a feeder base for supporting the intermediate feeder base.

BRIEF DESCRIPTION OF THE DRAWINGS

A preferred embodiment of the present invention will be elucidated with reference to the drawings, in which.

DETAILED DESCRIPTION OF A PREFERRED EMBODIMENT

Specialty hoppers, for example, card or cover feeders, may be necessary for some print jobs but may be removed for other print jobs. Moving card and cover feeders around to reconfigure a gathering device may be a time consuming activity that significantly reduces overall productivity. Typically, card and cover feeders need to be lifted by a crane, forklift or alternative lifting device in order to be removed from a conveyor or gathering line.

In some configurations, specialty feeders such as card and cover feeders do not mount in the same orientation as a standard hopper or feeder. Specialty feeders may mount with their drum axis perpendicular to the direction of travel of the gathering conveyor, varying 90 degrees from the mounting of a standard hopper or feeder. The drum and folding mechanism of the specialty feeders are centered over the gathering conveyor, for example, a gathering chain, putting the center of gravity of the unit outboard of the feeder mounting base, for example, a fixed base. Since the center of gravity is off the base and closer to the chain, the feeder would fall onto the chain if the feeder was unbolted. A system bringing the center of gravity back over the base may make removal of the feeder easier to manage.

Figure 1:
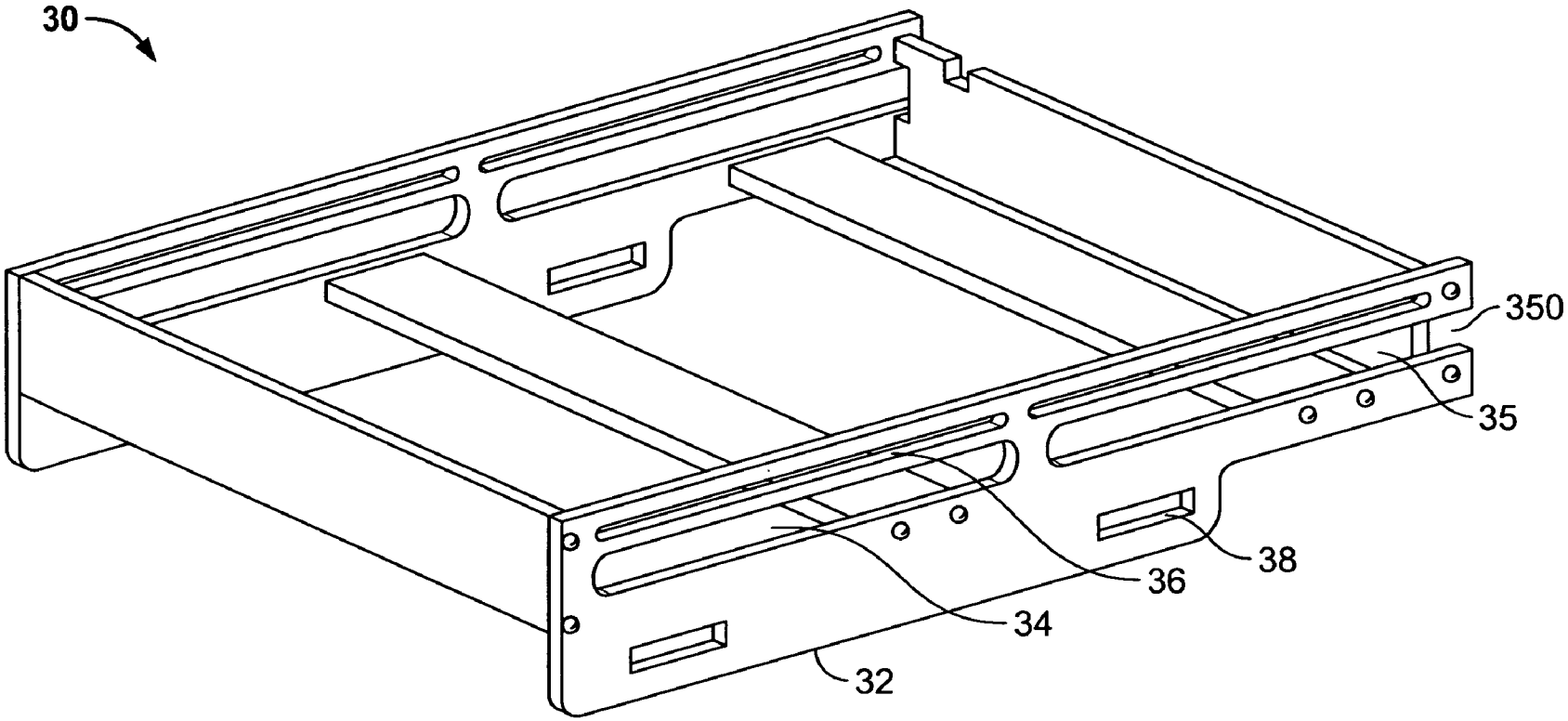
FIG. 1 shows a shuttle base according to the present invention.

FIG. 1 shows shuttle base 30 in accordance with the present invention. Shuttle base 30 includes a smooth bearing surface 32, longitudinal roller slots 34, 35, screw slots 36, and clamp slots 38. Longitudinal roller slots 34, 35 accept rollers to allow a feeder to be rolled from a cantilevered operating position to a balanced position and vice versa. Screw slots 36 accept screws that lock a feeder to shuttle base 30. Screws may lock the feeder in either the cantilevered operating position or balanced position.

Figure 2:
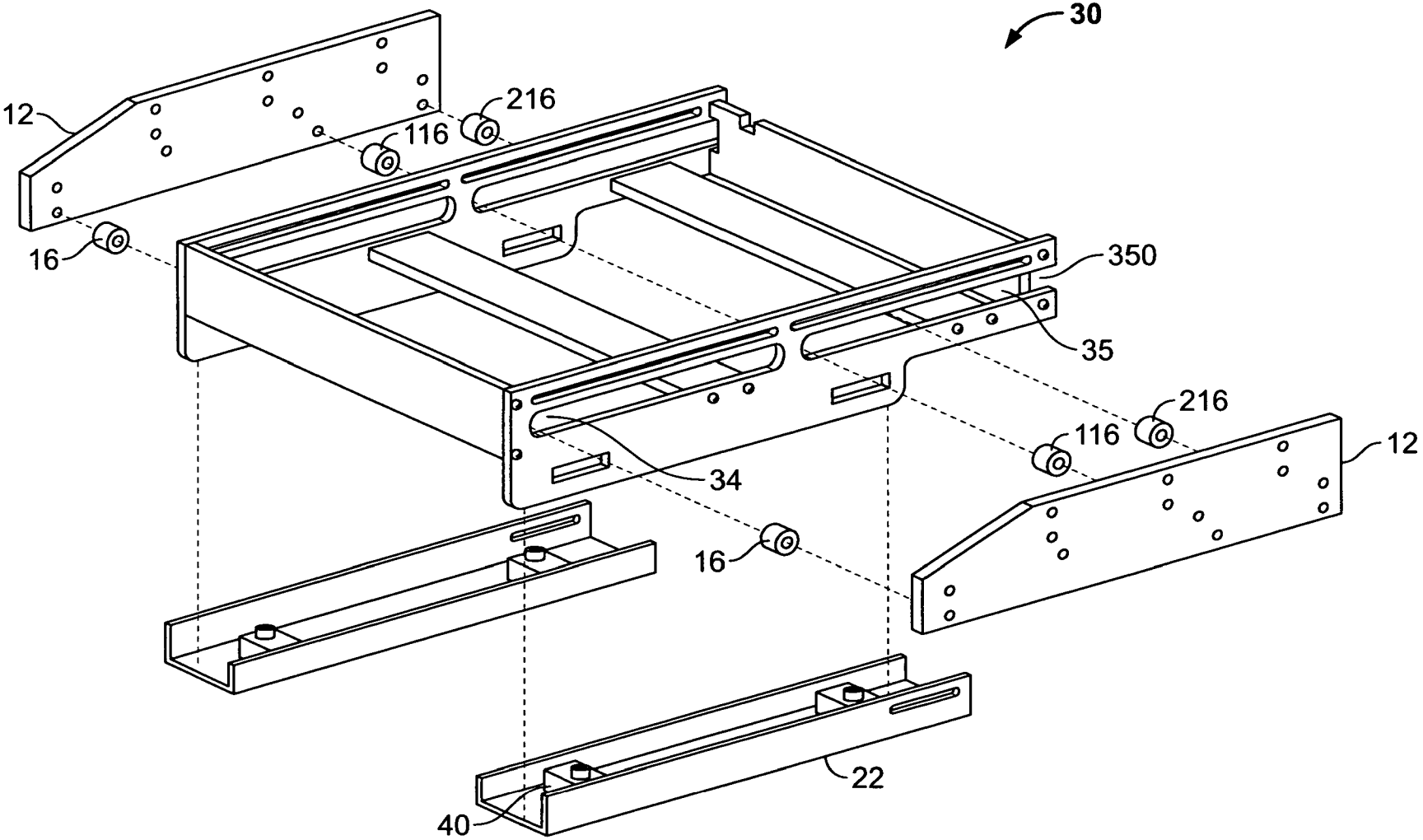
FIG. 2 shows the shuttle base of FIG. 1 and feeder side frames.

FIG. 2 shows rollers 16. Rollers 16, 116, 216 are fixed on one end to feeder side frames 12 and on the other end engage roller slots 34, 35 of shuttle base 30. Longitudinal roller slot 34 is designed to encase a roller 16. Roller 16 is limited to movement within slot 34. Longitudinal roller slots 35 include an open-end 350. Rollers 116 remain in slots 35 through movement between the balanced position and cantilevered operating position, however, rollers 216 are permitted to slide out of longitudinal roller slots 35 when side frames 12 and feeder 10 are moved to the balanced position. See FIG. 3B. As shown in FIGS. 2 and 4A to 4D, feeder side frames 12 are a rigid part of the feeder 10. Brackets 22 having spring-loaded clamps 40 are mounted on mobile base 60 and fixed feeder base 14. Spring-loaded clamps 40 secure feeder 10 and shuttle base 30 to brackets 22 via clamp slots 38 on mobile base 60 and fixed feeder base 14.

Figure 3A:
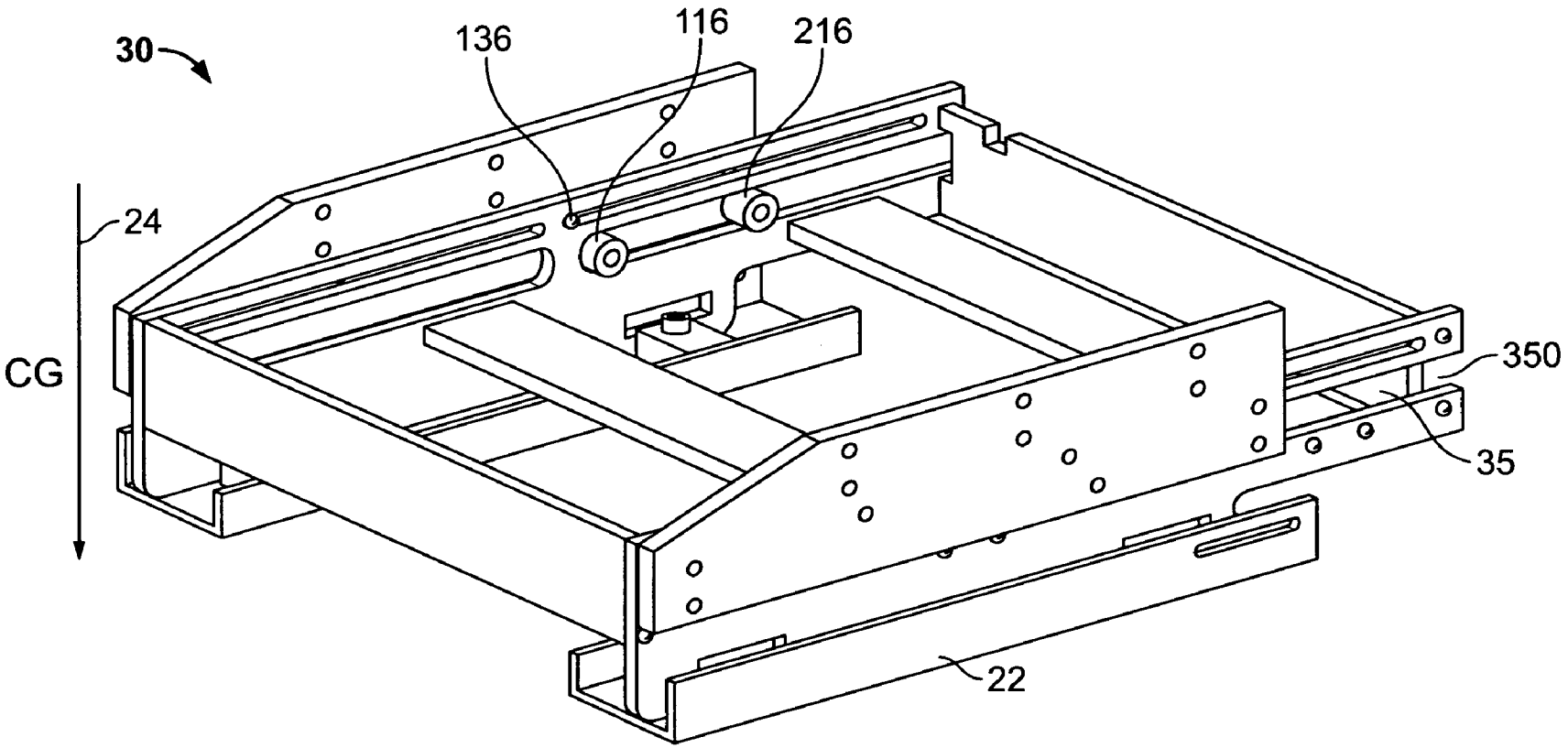
FIGS. 3A and 3B show the shuttle base in two positions.
Figure 3B:
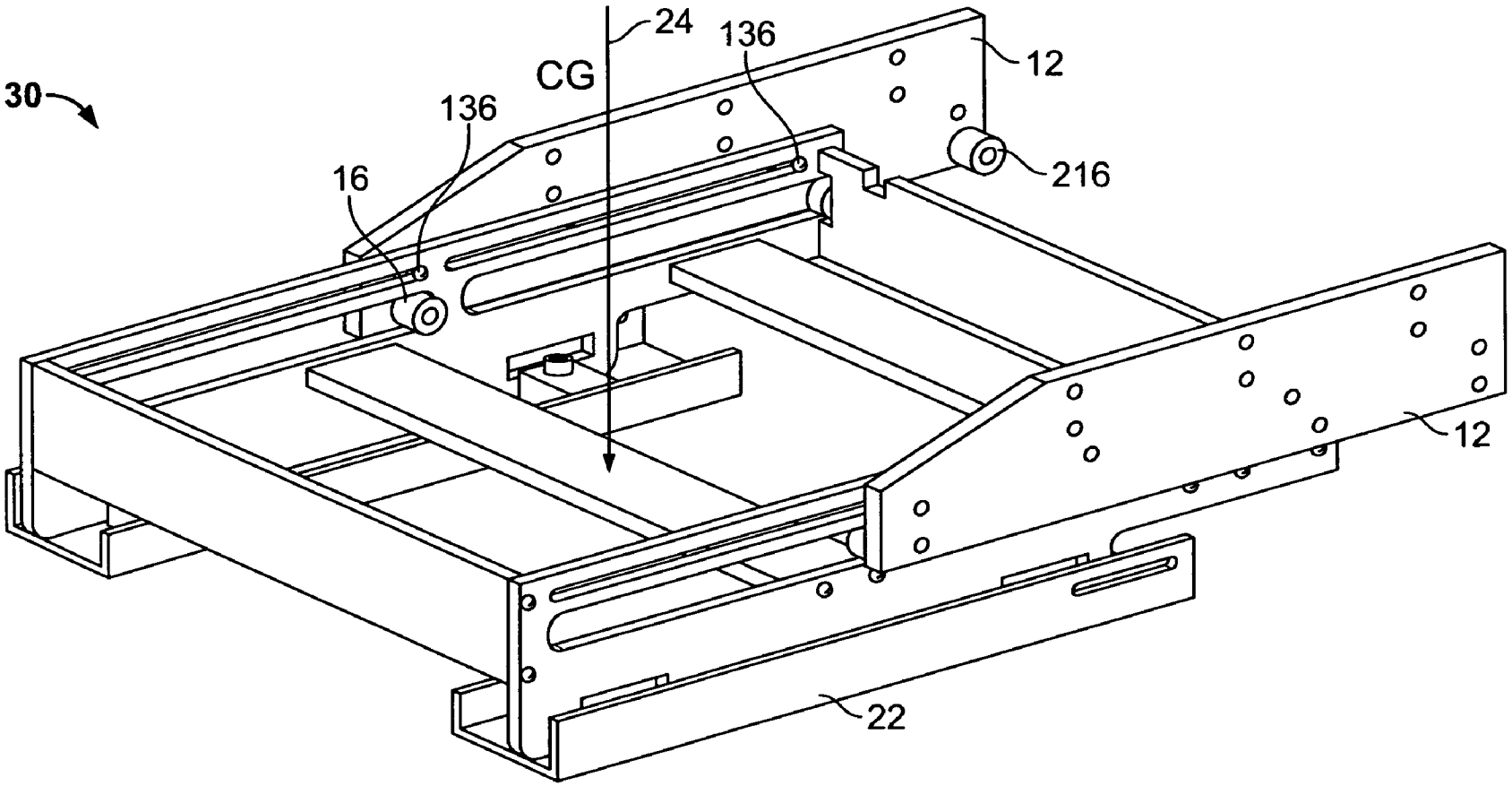
Figure 4A:
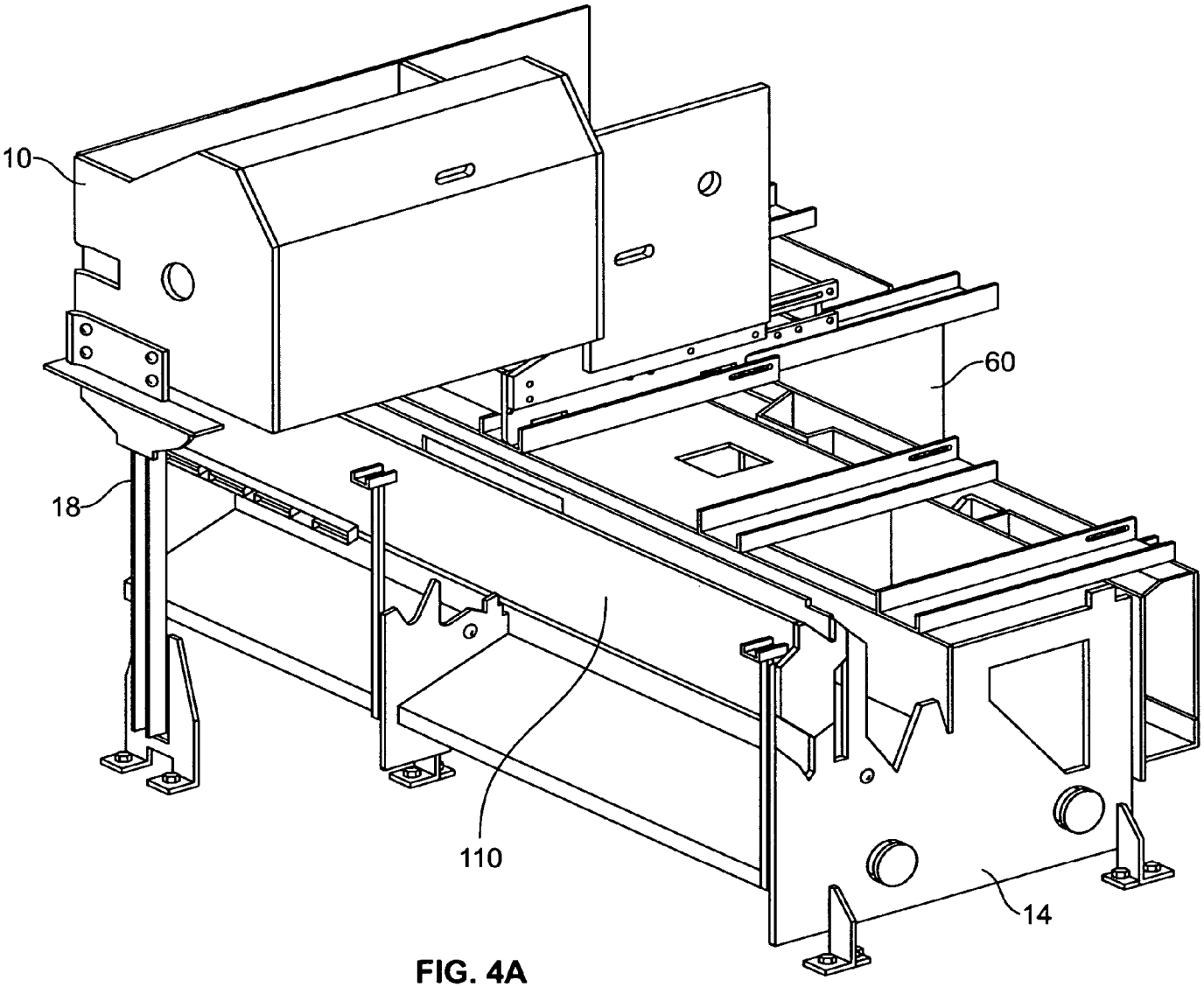
FIGS. 4A to 4D show the feeder, shuttle base, mobile base and fixed feeder base.

A center of gravity (CG) 24 of feeder 10 and shuttle base 30 is shown in FIGS. 3A and 3B. Feeder 10 is not shown to provide clarity in the details of shuttle base 30. Feeder 10 is shown in FIGS. 4A to 4D. When shuttle base 30 supports a feeder in the cantilevered operating position, feeder side frames 12 are rolled in the furthest forward position, for example, as shown in FIG. 4A, towards gathering chain 110. Screws 136 in screw slots 36 lock shuttle base 30 in the cantilevered operating position. Center of gravity 24 of feeder 10 is located over gathering chain 110 due to the design of feeder 10.

FIG. 3B shows shuttle base 30 in a balanced position. Feeder side frames 12 are rolled back and away from gathering chain 110. See FIG. 4B. In this position, rollers 216 have slid out of longitudinal roller slot 35, while rollers 16 and 116 remain in longitudinal roller slots 34, 35, respectively. Screws 136 in screw slots 36 lock shuttle base 30 in the balanced position. Longitudinal roller slots 34 are designed to enclose front rollers 16 so feeder 10 cannot slide off shuttle base 30. In the balanced position, center of gravity 24 lies over shuttle base 30. From the balanced position, an operator may move feeder 10 and shuttle base 30 as a single unit onto mobile base 60.

FIGS. 4A to 4D show moving a feeder 10 from a fixed feeder base 14 to a mobile base 60 via shuttle base 30. In FIG. 4A, feeder 10 is mounted to shuttle base 30 which is secured to fixed feeder base 14 by spring-loaded clamps 40. Feeder 10 is in the cantilevered operating position. In this position, center of gravity 24 is located in front of shuttle base 30. A leg 18, for example, may be used to reduce vibration of feeder 10 when feeder 10 is running at high speeds. Leg 18 is not needed to support feeder 10 and may be removed easily.

Figure 4B:
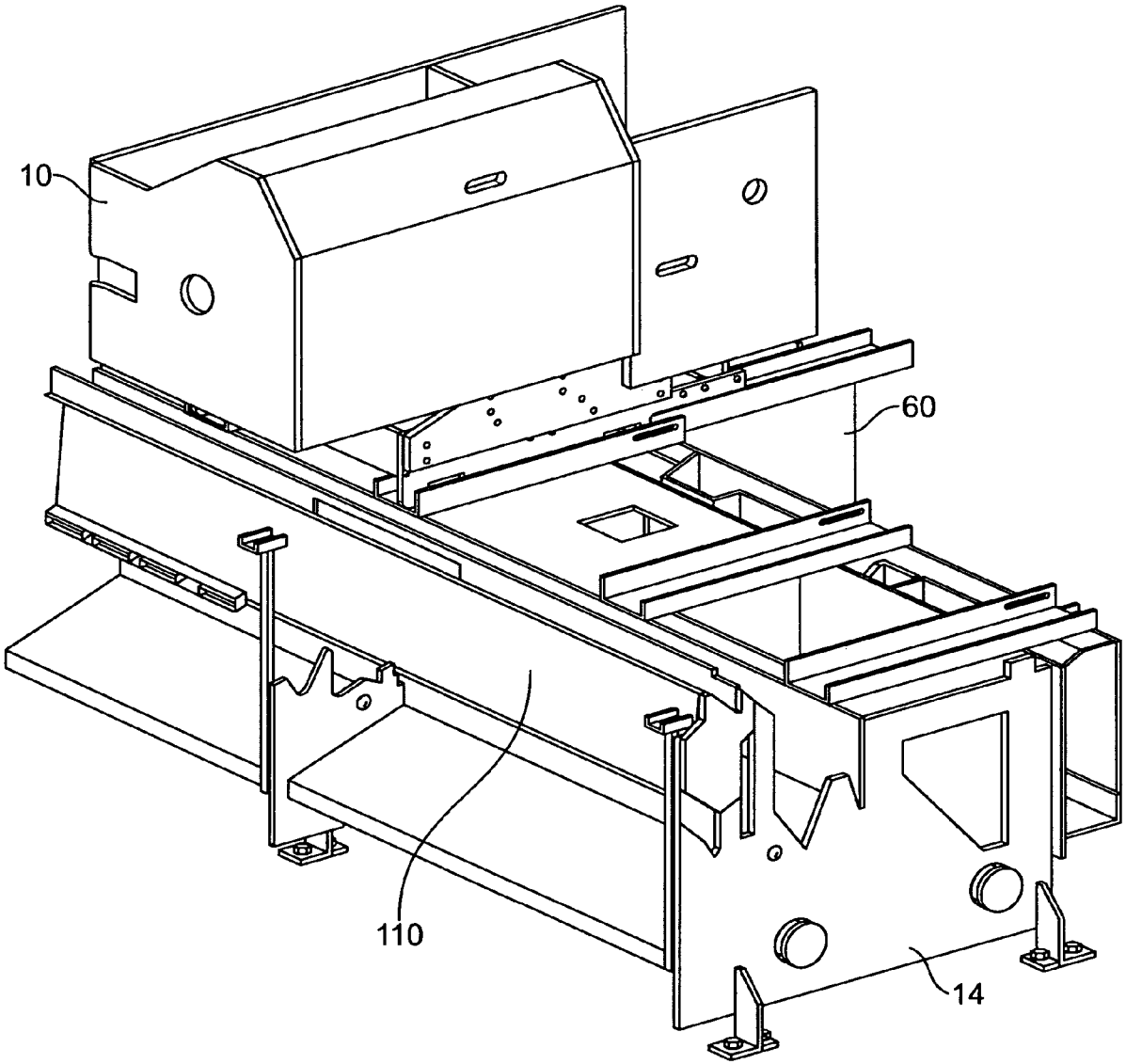

In FIG. 4B, leg 18 has been removed and locking screws 136 are loosened in order to slide feeder 10 back onto shuttle base 30 into a balanced position. During this time, shuttle base 30 remains firmly secured to fixed feeder base 14 via brackets 22 and spring-loaded clamps 40. Then, feeder 10 is rolled into the balanced position and center of gravity 24 is located over shuttle base 30. See FIG. 3B. Locking screws 136 are then tightened so shuttle base 30 and feeder 10 may be moved as a single balanced unit.

Figure 4C:
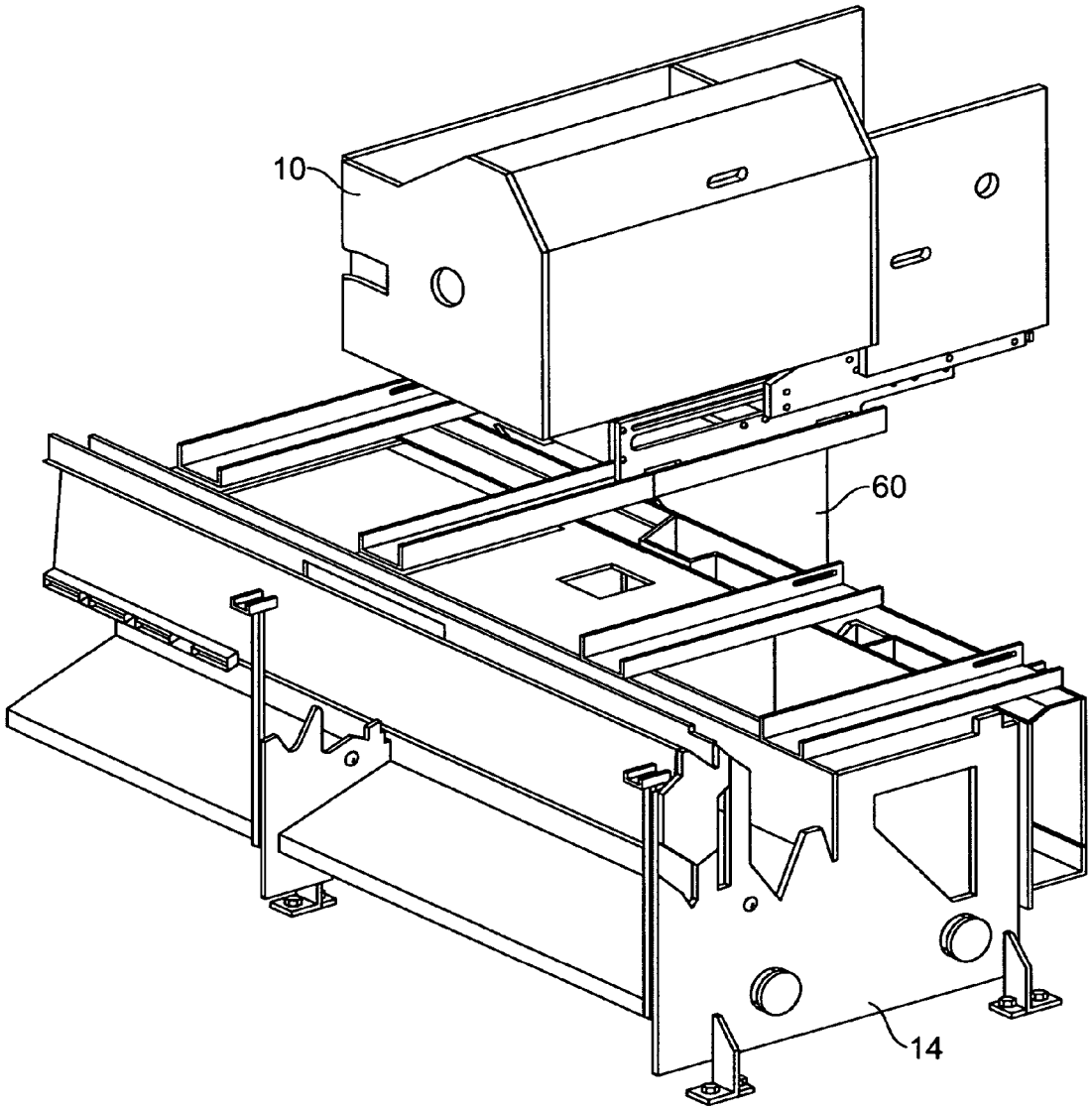
Figure 4D:
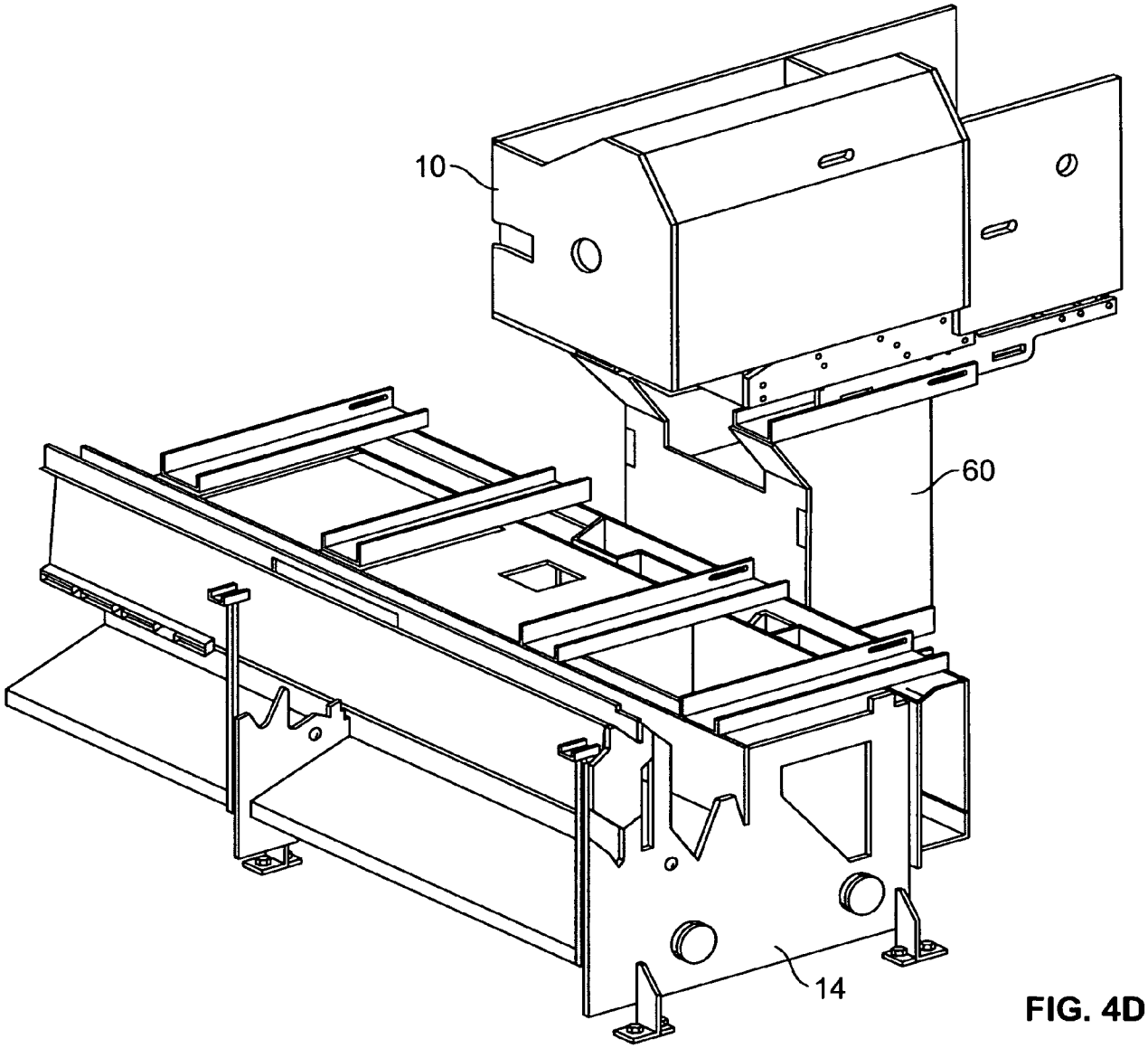

FIG. 4C shows feeder 10 and shuttle base 30 being transferred to mobile base 60. Spring-loaded clamps 40 are disengaged and slid out of clamp slots 38 as are any additional locking devices that may be provided. Feeder 10 and shuttle base 30 are then slid along brackets 22 on bearing surfaces 32 to mobile base 60. The spring-loaded clamps 40 on mobile base 60 are locked into position by pushing into clamp slots 38. Bolts on spring-loaded clamps 40 may be tightened to secure shuttle base 30 and feeder 10 to brackets 22 on mobile base 60. Thus, shuttle base 30 and feeder 10 are firmly secured to mobile base 60. Alignment devices, for example, may be provided on mobile base 60 and fixed feeder base 14 to ensure alignment is proper before moving feeder 10 and shuttle base 30.

Subsequently, mobile base 60 may be moved away from fixed feeder base 14 with shuttle base 30 and feeder 10 properly balanced. Feeder 10 may be, for example, pulled offline or moved to the other side of gathering chain 110.

Feeder 10 may be returned to fixed feeder base 14 by following this procedure in reverse.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A gathering device comprising:

a gathering conveyor; and a plurality of feeders, each feeder positioned to feed sheet material to the gathering conveyor;

at least one of the plurality of feeders being a mobile feeder, the mobile feeder including:

side frames having rollers, a center of gravity, an intermediate feeder base supporting the feeder for horizontal movement between a cantilevered position in which the center of gravity lies outside the intermediate base and a non-cantilevered position in which the center of gravity lies over the intermediate base, the intermediate feeder base including slots for receiving the rollers, and a feeder base for supporting the intermediate feeder base.

2. The gathering device as recited in claim 1 wherein the gathering device is a saddle stitcher.

3. The gathering device as recited in claim 1 wherein the gathering conveyor is a gathering chain.

4. The gathering device as recited in claim 1 further comprising a further feeder base for supporting the intermediate base, the intermediate base secured to the further feeder base by spring-loaded clamps.

5. The gathering device as recited in claim 4 wherein the further feeder base is a fixed base.

6. The gathering device as recited in claim 4 wherein the further feeder base is a mobile base.

* * * * *